US005125253A

United States Patent [19]

Gerretz et al.

[11] Patent Number: 5,125,253

[45] Date of Patent: Jun. 30, 1992

[54] COLD PILGRIM ROLLING

[75] Inventors: Josef Gerretz, Viersen; Horst Stinnertz, Willich, both of Fed. Rep. of Germany

[73] Assignee: Mannesmann AG, Fed. Rep. of Germany

[21] Appl. No.: 173,983

[22] Filed: Mar. 28, 1988

[30] Foreign Application Priority Data

Mar. 26, 1987 [DE] Fed. Rep. of Germany ..... 3709935
May 19, 1987 [DE] Fed. Rep. of Germany ..... 3717165

[51] Int. Cl.[5] ..... B21B 17/10
[52] U.S. Cl. ..... 72/208; 72/366.2
[58] Field of Search ..... 72/208, 366, 251, 96

[56] References Cited

U.S. PATENT DOCUMENTS 3,890,821 6/1975 Gerretz et al. ..... 72/208
4,285,226 8/1981 Gancia ..... 72/208
4,289,011 9/1981 Yoshiwara et al. ..... 72/208
4,361,023 11/1982 Blanquet et al. ..... 72/208
4,488,421 12/1984 Quecchia et al. ..... 72/96
4,638,655 1/1987 Sebastian ..... 72/208
4,658,617 4/1987 Peytavin ..... 72/208
4,724,697 2/1988 Hien et al. ..... 72/208

FOREIGN PATENT DOCUMENTS 0036105 3/1980 Japan ..... 72/208
1284633 1/1987 U.S.S.R. ..... 72/208

*Primary Examiner*—Irene Cuda
*Attorney, Agent, or Firm*—R. H. Siegemund

[57] ABSTRACT

A method of making tubing includes cold pilgrim step rolling wherein particularly a frame moves back and fourth carrying tapering rolls which roll in alternating directions upon the stock to be rolled whereby in addition a cylindrical mandrel is provided as well as turning and advancing facilities for the tube or pipe to be made and with further utilization of a rotatably driven clamping and holding device downstream for extracting the tubes or pipes being made.

8 Claims, 2 Drawing Sheets

11
5
2
6
4
10
7
9
8
AT
ET

COLD PILGRIM ROLLING

BACKGROUND OF THE INVENTION

The present invention relates to the making of tubing in accordance with the cold pilgrim step rolling method wherein particularly a frame moves back and forth carrying tapering rolls which roll in alternating directions upon the stock to be rolled whereby in addition a cylindrical mandrel is provided as well as turning and advancing facilities for the tube or pipe to be made and with further utilization of rotatably driven clamping and holding device downstream for extracting the tubes or pipes being made.

Cold rolling pilgrim step type rolling mills of the type to which the invention pertains and as outlined broadly above are known for some time and they have a certain inherent method of operation. This type of mill is presently used for the rolling of small thin walled tubes such as zircaloy tubes for nuclear reactor sleeves. The cold rolling in pilgrim step type and mode under utilization of a cylindrical mandrel has advantage that the ratio of wall reduction to overall diameter reduction can be quite large. This ratio is an important factor. For zircaloy sleeves when used in a nuclear reactor owing to a particular permeability for electrons. In the case of small internal diameter such as 5 mm it poses problems if conventional tapered mandrels are used in the cold, pilgrim step rolling. The quality of such mandrels leaves something to be desired and it is also difficult to position the requisite mandrel by means of the mandrel rod in rolling position.

Known mills of the type outlined above are disclosed e.g. in U.S. Pat. No. 4,090,386. Herein a long cylindrical mandrel is used and is being moved synchronously with the advance with the tube to be made in the direction of rolling. The particular mill and the commensurate rolling method being carried out have the disadvantage that any relative movement between rolled stock and mandrel is impeded. This means that additional longitudinal tension is set up in the mandrel. Owing to the high specific radial pressure that acts on the mandrel this additional tension increases the compensation tension so that the propensity of the mandrel to cold flow is increased; that is an undesired phenomenon. Broadly speaking, the danger exists that the mandrel itself is being rolled during the process.

On the other hand one could theoretically solve the problem by applying longitudinal compression on the mandrel, but that will not work since such a pressure has to be applied from the outside i.e. through the rather long mandrel rod; kinking and bend off can radially occur under such conditions particularly if the mandrels are not only rather long but also quite thin.

Practice and tests of rolling have verified that in case of unimpeded mandrel movement the velocity of the mandrel rod is smaller than the speed of the tube or pipe being rolled, but the speed of the mandrel is still larger than the advance speed of the hollow being rolled. This means that following rolling a particular length the mandrel is still stuck in the tube. One could separate mandrel and tube by using extraction devices that pull the respective tube off the mandrel. This approach requires additional structures arranged downstream of the mill for holding and clamping the tube. Moreover, this tube clamping actually means that locally the quality of the tubes or pipes being extracted may well be deteriorating. Also, additional structure is needed to move the mandrel rod and mandrel back i.e. against the direction of rolling whenever the remaining end is insufficient to reload a new hollow. Also, such a method would be time consuming and cumbersome because the long thin mandrel and rods have to be returned to a starting position outside the mill since in these cases one needs always several mandrels to work on a cyclic basis.

DESCRIPTION OF THE INVENTION

It is an object of the stated present invention to avoid the drawbacks of the prior art, to solve the problems outlined above and to improve accordingly process and equipment for pilgrim step rolling as outlined in the introduction.

It is a specific object of the present invention to combine the advantage of an unimpeded movement of the mandrel inside the rolled stock with a practical method for removing the completed tubing or pipe from the mandrel to be combined with suitable equipment for placing the next hollow into position under utilization of that same mandrel.

In accordance with the preferred embodiment of the present invention it is suggested to impart on the mandrel during rolling a relative speed to permit a relative movement between mandrel and hollow being rolled or even to actively introduce during rolling a speed differential via-a-vis the speed of rolling. After a particular transport path has been traversed by the tube or pipe, the mandrel, owing to its mobility, is moved back to a starting position. Preferably the relative speed between tube and mandrel comes about passively as a result of the rolling so that during rolling the mandrel is loaded axially, exclusively by the forces of rolling. Owing to some inevitable friction the mandrel is moved in the direction of rolling through engagement with the inner wall of the tube. Hence the invention uses the discovery that a reduction or impediment of longitudinal tensions in the mandrel precludes that the mandrel is actually being rolled so that actually a practicable process can result. This holds true only if these conditions are indeed fulfilled which in turn means that practicing the inventive method is a prerequisite for obtaining optimum qualities.

The relative speed between mandrel and rolling and/or the relative advance of the tube may obtain through pushing the rod in the direction of rolling. Pushing permits tuning of the rolling speed and of the mandrel advance speed such that any tension which may result from relative movement between the inner wall of the tube and the mandrel, is now subject to control.

The mandrel should be returned i.e. pulled back without interrupting the rolling process for example during one or several reciprocating passes and those particular end phases wherein there is no contact between rolled hollow and rolls. The mandrel will be pulled back specifically during a dead center position of a reciprocating frame i.e. in those instances when there is positively no contact between tube and roll. One may retract the mandrel in several smaller steps until the already rolled tube, there being in the zone of rolling but on discharge, is in contact only with a narrowed end or top of the mandrel. This way one obtains a continuous rolling operation while making sure that a new hollow is or can be already be threaded i.e. placed onto the retracted mandrel while the rolling process for the previous tubing still proceeds in its final phases. A sufficient length of the mandrel is required for taking up the new hollow.

In accordance with another feature the relative speed between mandrel and rolling may result in a follow up control of the mandrel rod. A holding force is provided to act on the mandrel and against the direction of rolling. In this case the mandrel will not float freely but is retracted in a controlled fashion. The still maintained relative movement between hollow and mandrel is now controlled corresponding to any technological requirement of rolling.

Equipment for practicing the inventive method includes the usual pilgrim step rolls, a reciprocating frame and a mandrel with holding and retraction equipment. In addition there is an upstream holding, advancing and turning device for the hollow and there is a downstream clamping structure. The mandrel has, preferably, a length is several multiples of the linear rolling (geometric) development of the rolls. If the mandrel floats during rolling the usable length of the mandrel should exceed twice the length of the hollows to be rolled. The mandrel may be coupled and decoupled from a retracting structure.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding to the detailed description of the drawings FIG. 1*a* shows a basically completed tube 1 just having a yet unrolled portion 1*a* to be rolled. The roll frame (not shown) reciprocates between positions ET and AT. Reference numeral 5 refers to clamping brackets or the like being basically stationary but rotating and being capable of moving the tubing out of the rolled stand.

Figure 1A:
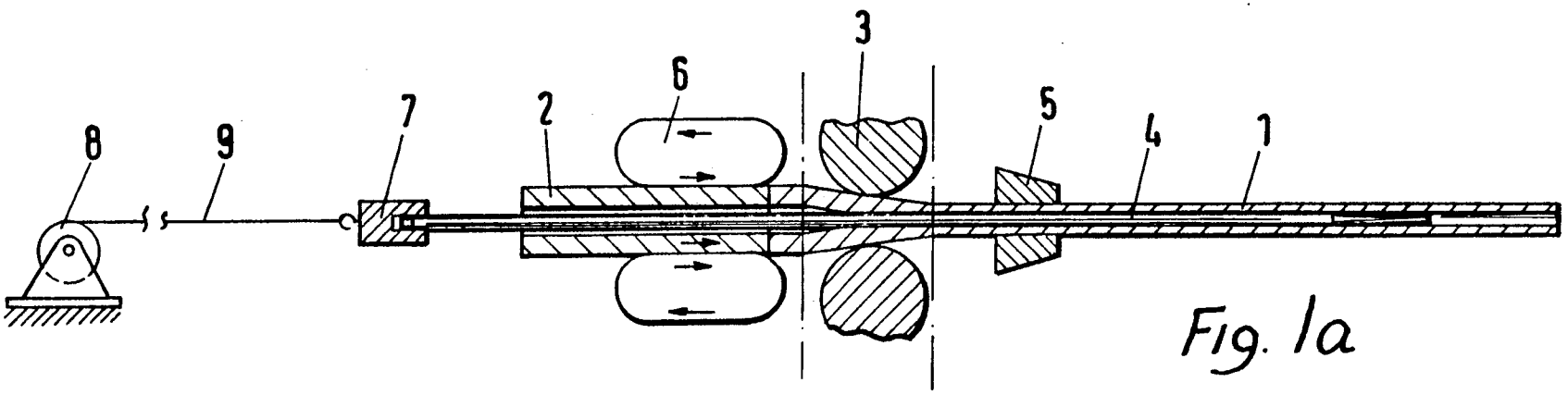
FIG. 1*a* illustrates somewhat schematically a cross section through rolling equipment in accordance with the preferred embodiment of the present invention for practicing the best mode thereof showing an instant following completion of rolling of a first tube.

The rolling is carried out under utilization of a mandrel 4. An end portion 11 of the mandrel 4 has a reduced dimension, the reduction being 0.05 mm. The length of the reduced portion corresponds to the distance between the end pair of the rolling by the smoothing portion of the roll 2 and the end of the brackets 5 plus 30 mm. The mandrel 4 is selectively being held in equipment which includes a rapid action coupling device 7, a cable 9 for holding and retracting device 7 and a winch 8 for the cable 9.

The relationship of the forces as described are the result of spring loading acting in conjuction with winch 8. Retraction and holding forces are provided by the winch 8 such that the spring force is smaller than the friction between the inner wall of the hollow (1, 2, 10 etc.) being rolled and the mandrel 4 during the process of rolling. The spring force however is larger than any friction when there is no contact between the respective tube and an engaging roll as has just been mentioned. This means that following coupling of the mandrel 4 to the device 7, 8, 9 a retraction or holding force is needed to be effective right when the frame for its rolls is in one of the dead center positions. During this phase the mandrel 4 is retracted until the roll reengages the tube. This retraction may obtain in one step or in several steps while rolling actually continues. However, the machine may be operated such that the rolling process stops during the mandrel retraction phase. The device 7, 8, 9 generally being retraction and holding device, should be provided with an automatic motion limiting device to restrict displacement in one direction or the other.

During mandrel retraction the tube has to be held and for this the device 6 is quite suitable. Broadly speaking FIG. 1*a* shows in fact the next tubing or hollow (2) to be rolled, in FIG. 1*b* that next hollow is identified with the reference numeral 10. Device 6 may be an endless device with chains being rotatable about a longitudinal axis. A device suitable for this purpose is not part of the present invention, and known equipment can be used such as shown in German patent 2,034,315. However, newer suitable equipment is disclosed by one of us in a copending application U.S. Ser. No. 07/170284, filed Mar. 18, 1988.

FIG. 1*a* shows specifically the situation in which essentially most of tubing 1 has been completed and a new hollow 2 is being advanced by the transport mechanism 6. 1–2 is the boundary or abutment zone between the tubing 1 being rolled and the new hollow 2, presently held in preparation. Moreover, FIG. 1*a* illustrates that the mandrel 4 has assumed its foremost position. The brackets 5 have been closed during the rolling, and are now opened as rolling stops so that the rolls 3 in fact do not rotate any longer while their journalling frame is in one of the two dead center positions (AT, ET) of reciprocation without having actually contact with the rolled stock. The trailing part 1*a* of tube 1, is still being rolled still having in parts the dimensions of the original hollow.

The stationary stock rotating and advancing mechanism 6 holds whatever it holds (namely new hollow 2) stationarily during the immediately following phases. During regular rolling the device 6 is operated to advance or rotate or both, the stock to be rolled as the pilgrim step process proceeds. Ser. No. 170,284, filed Mar. 18, 1988, corresponding to German Priority application P 37 09 008.9 of Mar. 19, 1987, having been published in the meantime. Now the mandrel rod is being retracted by the device 7, 8, 9 which holds onto hollow 2 so that the mandrel can in fact be retracted. There being necessarily some friction but the mandrel 4 clears the internal hollow of the not yet rolled stock. The rolling process may have stopped during the retraction. Of course there is friction between the mandrel 4 and the tube 1 as the mandrel 4 is retracted. As stated, the coupling 7 provides the requisite connection between the cable 9 on the winch 8 and the mandrel 4 so that now the winch 8 through the cable 9 and coupling 7 can retract the mandrel 4.

Figure 1B:
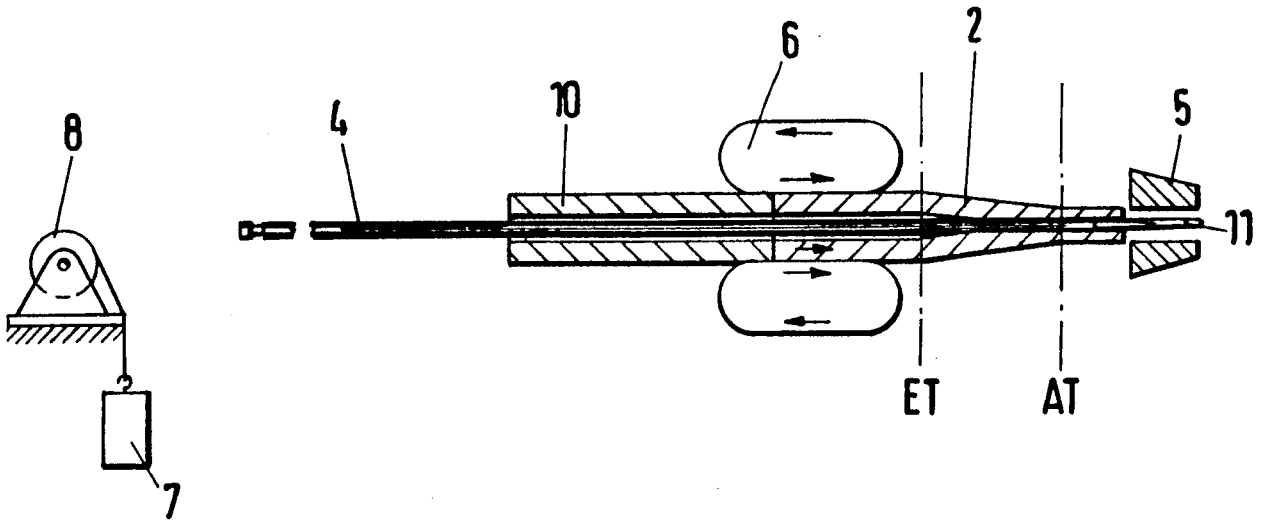
FIG. 1*b* is a view similar to FIG. 1*a* but now showing the retracted rolling mandrel.

The retraction of mandrel 4 obtains to a sufficient degree so that the completed tube can be removed and the next hollow (10) can be threaded onto the mandrel 4. FIG. 1*b* illustrates the situation following the retraction of the mandrel and after the rolling of hollow 2 has begun. The mandrel 4 has been retracted such that the previously rolled stock 1 will engage first the tip portion 11 of the mandrel being about 0.05 mm thinner than the main portion of the mandrel. This way then the tube 1 could be removed from that smaller (thinner) mandrel portion without any problem. The brackets 5 of course were open. In accordance with the further feature of the invention release and removal of the rolled tube 1 from the mandrel 4 obtains through the rolls 3 in the last protion that is used during the rolling through appropriate dimensioning so that in fact the rolling process pulls the tube off the mandrel which as stated has reduced diameter portion 11.

Following mandrel retraction the rapid coupling 7 had opened and the new blank and hollow 10 was threaded onto the mandral 4. This means that a new cycle could begin. The figure 1*b* shows the situation a little afterwards. The next hollow namely 2 is already partially rolled and the blank 10 has reached the range of the transport device 6. A structure for transporting and moving the hollow 10 until it is gripped by the device 6 provides for advanced movement and is not illustrated. FIG. 1*b* shows the phase of operation shortly after the blank 2 has begun to be rolled and certain front portion is already of the same dimensions as the tube to be made. Then it will reach the brackets 5 and to be gripped thereby.

Figures 2A, 2B, 2C, 2D:
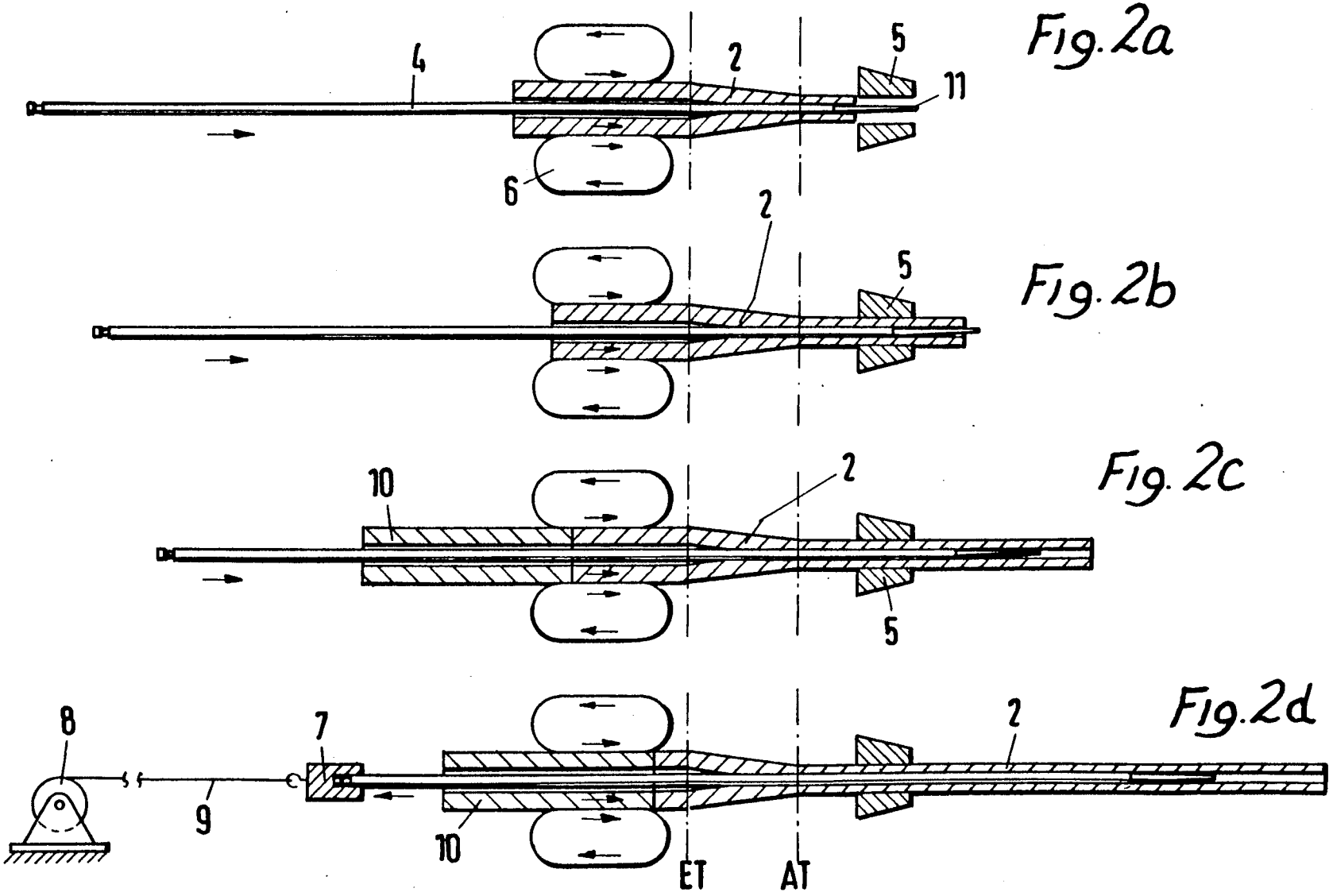
FIGS. 2*a*–2*d* are schematic showings similar to FIGS. 1*a* and 1*b* and showing a full cycle with continuous circulation of a single mandrel and using certain phases for retracting and reloading the mandrel.

FIG. 2 in portions a–d shows, in parts an alternative operation wherein in fact the reloading can be carried out without stopping the mill at all. There is a first phase (2*a*) which is a phase similar to the one showing in FIG. 1*b*. Equipment of a comparable nature is included also in this embodiment. The previously completed tube was just removed and the situation is indeed analogous to FIG. 1*b*. The currently rolled hollow 2 is in the zone of rolling as defined between ET and AT. As before they are the dead center positions of the rolling frame in which the rolls are mounted. The positions ET and AT also mark the dead center positions where the frame returns. The rolling is, of course, as stated, of the pilgrim step variety which reciprocates between these points. Equipment of this type is known and does not constitute part of the invention. The devices 5 and 6 are stationary. FIG. 2*a* shows the mandrel 4 to be in a particular position in which a portion still projects from that portion of tube 2 which has already been rolled. Earlier the previously rolled tube (such as 1 in FIG. 1*a*) was moved off the mandrel stop 11. The portion of tube 2 already rolled is located in this instant between the still open clamping brackets 5 and the dead center position AT on the other end. A portion that has partially been rolled extends between the two points AT and ET which defines the rolling zone. To the left of ET the yet unmodified hollow 2 is held by the device 6.

FIG. 2*b* illustrates the rolling process of hollow 2 in a somewhat advanced phase. The bracket 5 has now closed, the mandrel 4 is being moved on account of the deforming process and owing to the engagement with the rolled stock; mandrel 4 has been decoupled from the devices 7–9. Owing to the rolling process and thus ensuring friction on the inside of the tube, the mandrel will advance faster on the average than the not yet rolled portion but slower than the tubing portion that has just been rolled.

FIG. 2*c* shows further process of rolling the hollow; a larger portion thus shown in FIG. 2*b* has been completed, and the rolled portion extends over beyond the mandrel 4 and particulary the smaller end 11 thereof. The mandrel 4 is still movable and there is supplemental tension acting on the mandrel in the direction of rolling. In the meantime a new blank 10 has been threaded onto the rear of the mandrel 4. It was not necessary to stop the rolling process for that purposes. The newly threaded on or placed on hollow blank 10 was placed on the mandrel 4 before the trailing end of hollow balnk 2 had been fully engaged by the device 6 so that the front end of new hollow 10 could be advanced into an abutting position with the rear end of 2 FIG. 2*c* shows that the upstream end of device 6 has now gripped hollow 10. 2 and 10 continue in abutment with each other, just as if they were one hollow.

FIG. 2*d* shows mandrel 4 in an extreme forward position as far as completion of rolling a hollow is concerned (see also FIG. 1*a*); the rolling process as far as tube 2 is concerned has not jet been completed. The position of mandrel 4 is such that it has traversed maximal transport path within the cyclic operation. From that position it will be slowly retracted by the device 7–9, while rolling of tube 2 is completed. This completion the coupling 7 was coupled to the rear of the mandrel 4. The slow retraction of mandrel 4 does not interfere nor does it impede the rolling process which in fact continues. The retraction force is such that the friction between tube 2 and mandrel 4 during rolling are larger than the retraction force. On the other hand, the retraction froce provided by the winch 8 is larger than the friction between tube and mandrel in the dead center of the frame when the rolls are in fact retracted from the hollow. Thus the mandrel 4 will be retracted in steps but only during those periods when the frame is in one of its two dead center positions. In other words one uses also here the dead center situation of the rolling process for purposes of retracting the mandrel so that the rolls and the rolling bsically continue as before. The retraction obtains until position is reached similar to the position of 2*a*. The position between the figures is different; the mandrel is retracted slowly but the rolling process continues on the transition from FIG. 2*d* to FIG. 2*a* which shows that the previous tube, still rolled prior to and during the retraction, has now been completed and has been removed. In the meantime the new hollow 10 (FIG. 2*d*) is well advanced by and through the device 6 and will in fact be the one that is rolled next (10 instead of 2). The cycle has started anew.

The invention is not limited to the embodiments described above but all changes and modifications thereof, not constituting departures from the spirit and scope of the invention, are intended to be included.

We claim:

1. In a method for cold pilgram step rolling using a reciprocating frame having tapered rolls journalled thereon, said rolls rolling alternatingly with respect to rolled stock, the method further including using essentially cylindrical mandrel upon which hollow stock is being rolled by said rolls and still further using a turning and advancing structure for the hollow stock to be rolled upstream from the rolls, the improvement of:

providing for a relative speed between the mandrel and the rolled hollow stock, during the rolling of the stock to obtain a tube, and in relation to the tube thus being rolled, so that the mandrel can be retracted; and retracting the mandrel from the tube, during a last phase of rolling the tube.

2. Method as in claim 1 in which said retraction is carried out in steps during a plurality of dead center positions of the frame.

3. Method as in claim 1 including the step of pushing the mandrel in the direction of rolling.

4. Method as in claim 1, wherein the mandrel is not held during rolling so that a fresh stock hollow can be placed onto the mandrel to be available immediately after rolling of the previous hollow stock.

5. Method as in claim 1, and including controlling the speed of the mandrel, the mandrel no floating during rolling.

6. Method as in claim 1, the mandrel being permitted to float during an advancing step of reciprocating rolling.

7. Method as in claim 1, including the step of holding the mandrel during a retraction step and applying a spring froce thereto which is smaller than the friction between the inner wall of the hollow (1,2,10 etc.) beint rolled and the mandrel during the process of rolling.

8. Method as in claim 1, wherein the retraction of the mandrel is carried out by a spring force which is larger than the friction between the hollow stock and the mandrel for disengaged rollers, but smaller than the same kind of friction during rolling.

* * * * *